US006052830A

United States Patent [19]

Payne

[11] Patent Number: 6,052,830

[45] Date of Patent: Apr. 25, 2000

[54] COMBINED CAPE AND COVER FOR VISOR OR THE LIKE

[76] Inventor: Virginia P. Payne, 191 Roy Dr., Madison, Ala. 35756

[21] Appl. No.: 09/225,648

[22] Filed: Jan. 5, 1999

Related U.S. Application Data

[60] Provisional application No. 60/070,469, Jan. 5, 1998.

[51] Int. Cl.[7] ..... A42B 1/18

[52] U.S. Cl. ..... 2/171.1; 2/12; 2/195.1; 2/209.11; 2/209.13; 2/425; 2/172

[58] Field of Search ..... 2/12, 171.1, 172, 2/195.1, 202, 425, 175.6, 209.11, 209.13

[56] References Cited

U.S. PATENT DOCUMENTS

| | | | |
|---|---|---|---|
| D. 312,526 | 12/1990 | Rohmig . | |
| 822,986 | 6/1906 | Rochet . | |
| 946,770 | 1/1910 | Sands . | |
| 2,897,510 | 8/1959 | Forbes-Robinson . | |
| 3,469,264 | 9/1969 | Harris . | |
| 4,345,336 | 8/1982 | Plastino | 2/171.1 |
| 4,980,928 | 1/1991 | Ellis | 2/88 |
| 5,046,195 | 9/1991 | Koritan . | |
| 5,201,077 | 4/1993 | Dondlinger . | |
| 5,355,535 | 10/1994 | Bruder | 2/172 |
| 5,623,732 | 4/1997 | Olajide, Jr. | 2/195.1 |

*Primary Examiner*—Diana Oleksa
*Attorney, Agent, or Firm*—Mark Clodfelter

[57] ABSTRACT

Protective head wear or cover for use in conjunction with a visor is disclosed. A top hair cover is provided with a front bill cover having an elastic front edge. This elastic front edge is fitted underneath the front edge of the bill of the visor, holding the protective cover in place. A lower rear edge of the cover is provided with elastic so as to assist in holding the cover to the back of a head of a user. A cape may be removably attached to this lower rear edge, the cape further provided with a drawstring for securing the cape about the neck of the user. Significantly, the cover and cape are constructed of a light weight, water resistant vapor permeable material for enhancing comfort of the user and preventing disturbance to a hairdo of the user. The drawstring gathers the cape about the neck of a user so that when the user bends forward, the cape remains secured about the users neck, preventing interference with vision and are movement.

15 Claims, 4 Drawing Sheets

COMBINED CAPE AND COVER FOR VISOR OR THE LIKE

CROSS REFERENCE TO RELATED APPLICATION

This application is a continuation-in-part of provisional patent application Ser. No. 60/070,469, filed Jan. 5, 1998.

FIELD OF THE INVENTION

This invention relates to waterproof covers adapted to be fitted over visors, and particularly to such a cover having a detachable cape for covering the back of the neck and shoulders of the user.

BACKGROUND OF THE INVENTION

During participation of outdoor sports, particularly golf, an individual engaging in the sport may be exposed to the elements for a prolonged period of time. Over this period of time, the weather may become inclement, resulting in a need for protection. As some golf tournaments are played in rainy, foggy or misty conditions, players may need to carry umbrellas and wear hats for protection.

For male golfers, wearing a hat is not a problem as most men wear their hair relatively short. On the other hand, most women prefer to have longer, cosmetically arranged hair in the form of a "hairdo" over which a hat will not fit. As a result, many women prefer to wear visors, which are open at the top, in order to shade their eyes. However, where rain or mist is present, a visor will not protect a hairdo, which will not withstand rain or misty conditions. In addition, it is further desirable to provide protection for shoulder-length or longer hair against rain, drizzle or misting conditions.

While several hats provided with a shoulder cape have come into being, it is believed that all of these devices would crush or otherwise disturb a hairdo worn by a woman. Further, several of these shoulder capes would become an interference when a golfer is in the process of putting a golf ball. Here, as the golfer bends over to putt, the capes of the prior art would swing downward and either obstruct the golfer's vision or interfere with the motion of the golfer's arms. As such, these prior art capes are unsatisfactory when used during the playing of golf.

In view of the foregoing, it is one object of the invention to provide a cover worn in conjunction with a visor to protect at least the hair, and possibly shoulders, of the user from precipitation. Other objects of the invention will become clear upon a reading of the following specification.

SUMMARY OF THE INVENTION

A cover for use in conjunction with a visor is provided. An upper cover for covering hair of the user fits over the head of a user and is provided with a bill cover having an outer elastic periphery for engaging an underneath side of the bill of the visor. Thus, the cover is attached to the bill of the visor and covers and protects hair of a user without disturbance to a hairdo of the user.

DETAILED DESCRIPTION OF THE DRAWINGS

Figure 1:
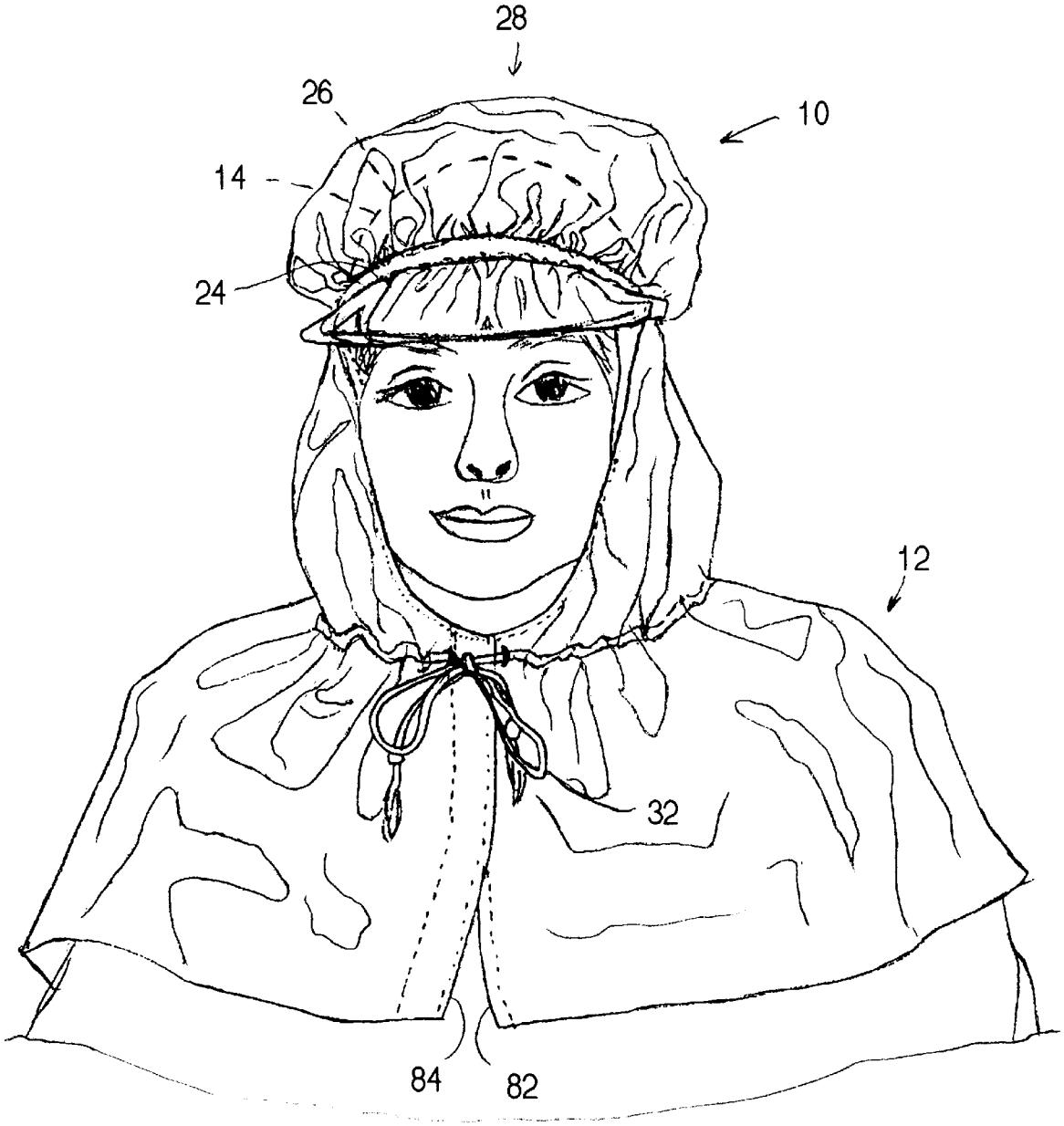
FIG. 1 is a front view of a combined visor cover, head cover and cape as contemplated by the present invention.
Figure 2:
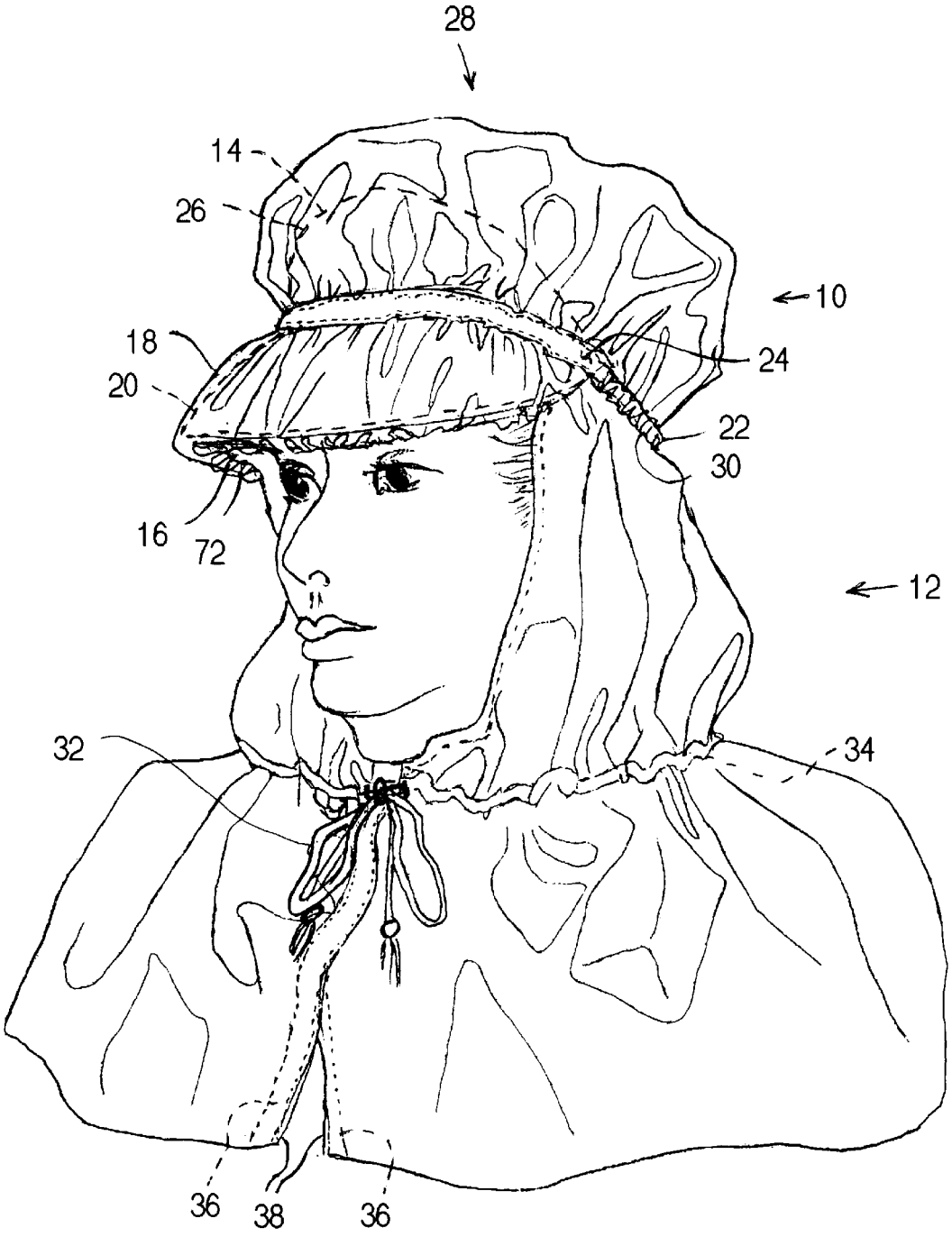
FIG. 2 is an oblique view of the cover shown in FIG. 1.
Figure 3:
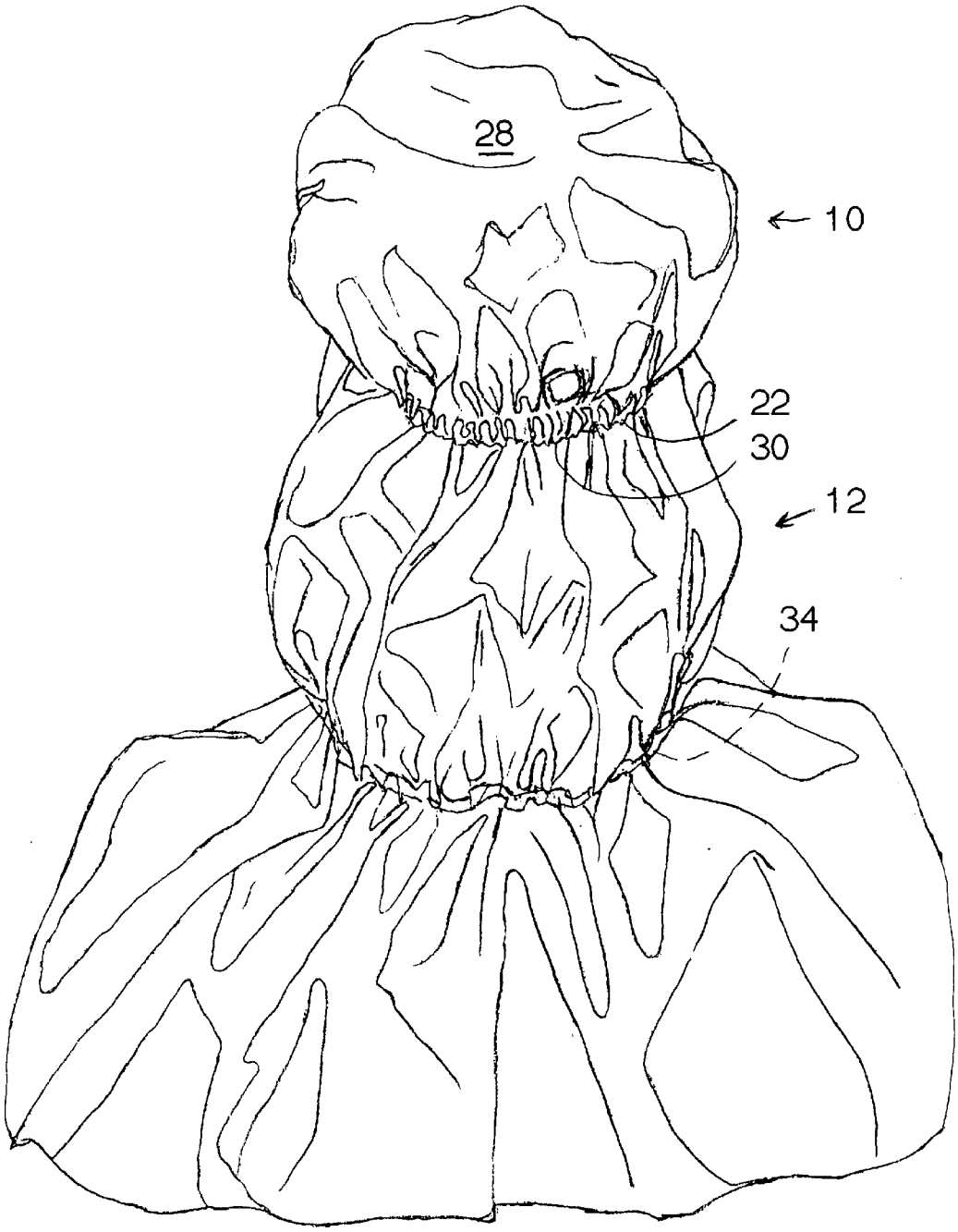
FIG. 3 is a rear view of the cover shown in FIG. 1.

Referring initially to FIGS. 1, 2, and 3, one embodiment of my visor cover 10 and detachable cape portion 12 is shown as it would appear during use. Cover 10 and cape 12 may be constructed of a waterproof and possibly of a "breathable" flexible fabric or fabric-type material that allows air and vapor to circulate through the cover and cape, repelling rain while enhancing comfort of the user. Alternately, cover 10 and cape 12 may be constructed of an ordinary fabric and treated with a water repellent coating, such as a Scotchgard-type product. Cover 10 is specifically constructed to be fitted over a visor 14 (dashed lines), the construction of which characterized by being open at the top and typically held to the head of a user by extensions that fit above the ears, as is well known to those skilled in the art. A first gathered region 16 hemmed with elastic (FIG. 2) holds a bill cover portion 18 over bill 20 of the visor. A second gathered region 22 also hemmed with elastic may extend from a headband region 24, and serves to hold a rearward portion of cover 10 to the back of the head of the user. Here, gathered region 22 and the rearward portion of the cover may be sized such that hair of the user is covered, with gathered region 22 extending around the nape of the neck. Alternately, gathered region 22 may be omitted entirely, with the rearward portion of the cover simply positioned loosely about the back of the head or neck of the user. As such, a hairdo of the user would be minimally disturbed by cover 10. In this embodiment, the cover would be held in place only by the elastic around the bill, with the rest of the cover resting loosely against hair of the user. Headband region 24 fits as shown in the crease between bill 20 and an upstanding portion 26 of the visor, or simply along a headband region of the visor for visors that lack an upstanding region 26.

As described, upper portion 28 of cover 10 may be constructed of a flexible fabric material having waterproof or water repellent characteristics and which covers the hair of the user. As such, portion 28 may be sized so as to adequately cover almost any hairdo typically worn by women without damaging the hair styling. As stated above, this is in contrast to a hat or other hard or firm head covering, which invariably compresses the hair and thus damages styling thereof. Applicant's flexible fabric cover, in conjunction with a visor, provides a waterproof cover for the head and hair without damaging styling of the hair.

Cape 12 may also be constructed of the described fabric material, and is attached, as by hook-and-loop tape, snaps, buttons, zippers or other fasteners, to the lower inner side 30 of gathered region 22 of cover 10. With this construction, the lower inner side 30 of the cover overlaps cape 12 so that water dripping from upper portion 28 of the cover falls directly onto cape 12, with no interface through which the water may seep and wet the user. As shown, cape 12 may be sized so as to cover that portion of the back of the neck not covered by the rearward portion of cover 10. Additionally, cape 12 may be adapted to cover shoulders of the user, and may be further provided with a drawstring 32 slidably disposed in a channel 34 along the inside of the cape for gathering the cape about the lower region of the neck and below the chin of the user. Hook-and-loop tape 36 (FIG. 2) or other fasteners as described above may be provided along front edges 38 for holding cape 12 closed along the front. Significantly, construction incorporating a drawstring about the lower region of the neck prevents the cape from falling forward to cover the face or block peripheral vision of the user when the user bends forward, as when driving or putting a golf ball.

Figure 4:
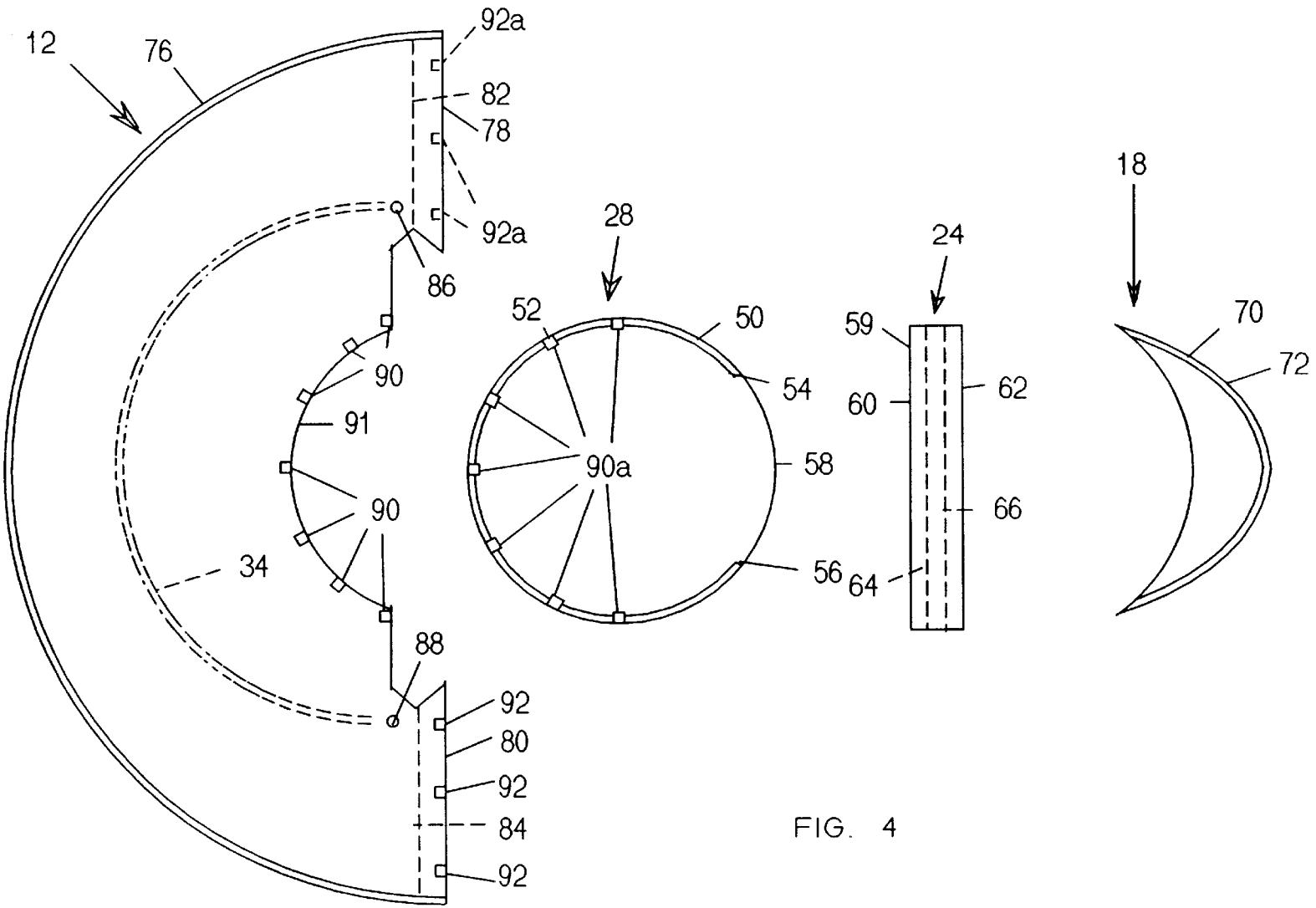
FIG. 4 is a view illustrating a pattern for fabricating a cover as contemplated by the present invention.

Referring now to FIG. 4, one example of how a cover 10 may be constructed is shown. Here, upper portion 28 may be formed from a circular or slightly oblong portion of material 50 which is gathered with elastic at least about a periphery 52 extending counterclockwise from points 54 to 56, allowing a portion 58 to remain ungathered where the headband region 24 is attached to upper portion 28. In a different embodiment, and in order to simplify construction, the entire periphery of piece 50 may be gathered with elastic prior to attaching headband 24 and bill cover portion 18. Here, gathering the entire periphery of piece 50 makes the appearance of top 28 contiguous between the elastic gathered region 22 and headband region 24. Also, by gathering the material in the area adjacent the headband, the material in this area tends to "stand up", as seen in FIGS. 1 and 2.

Headband portion 24, as shown in FIG. 4, may simply be a straight piece of material 59 of sufficient width such that front and back sides 60 and 62, respectively, may be folded under along dashed lines 64 and 66 and folded under at the ends prior to sewing in order to give a finished or hemmed look to headband portion 24. Alternately, headband 24 may be constructed of a tape-like material having finished edges, or omitted entirely.

Bill cover portion 18 may be constructed of a crescent-shaped piece of material 70 having an edge 72 gathered with elastic so that edge 72, when elastically positioned underneath bill 20 of the visor, as shown in FIG. 2, holds bill cover 18 in place over bill 20 of the visor. Bill cover 18 may be attached, as by sewing, to headband region 24 adjacent folded edge 66 thereof, with the headband portion 24 in turn attached adjacent folded edge 64, again as by sewing, to edge 58 of upper region 28. As stated, edge 58 may be preferentially be gathered, but may alternately be left ungathered. In another embodiment, bill cover portion 18 may be constructed integrally with upper portion 28. Here, headband portion 24 may be added to further define bill cover region 18 and upper region 28 and provide a reinforced area against which gathered region 22 pulls.

Detachable cape 12 is basically constructed of a semicircular-shaped piece of material 76, which as stated is sized to cover that portion of the neck not covered by gathered region 22, and shoulders of the user. The periphery of cape 12 may be hemmed along line 77 or otherwise finished to prevent ravelling. Front edges 78 and 80 may be folded along dashed lines 82 and 84, respectively, and attached, as by sewing, to provide reinforced regions along opposed front edges of the cape. Openings 86 and 88 are provided as shown, with each of these openings communicating with a channel 34 adapted to receive drawstring 32 (FIGS. 1 and 2). Channel 34 may be formed by attaching a separate piece of tape-like material, such as hemming tape, along its edges to the inside surface of cape 12. After the cape is finished, one part of two-part hook-and-loop tape may be sewed or otherwise attached to the cape at positions approximately indicated by 90 along semicircular edge 91, with corresponding parts of the hook-and-loop tape being attached around the rear periphery of top 28 at positions approximately indicated by 90*a*. Alternately, continuous pieces of hook-and-loop tape may be affixed about the rear periphery of piece 50 and semicircular edge 91. In addition, the cape may be closed at the front by hook-and-loop tape extending continuously along edges 78 and 80, or small sections of hook-and-loop tape may be affixed generally as shown at selected locations along the front edges of cape 12. Further yet, instead of a drawstring, the region where a drawstring is shown may be replaced in whole or in part, by a gathered region incorporating or sewed with elastic material. As such, the hook-and-loop tape or other fastener would serve to close the cape at the front and secure the cape about the neck of a user.

In use, the cover is fitted over the visor, as by fitting bill cover portion 18 over bill 20 of the visor. The visor may then be placed on the head, with upper portion 28 covering hair of the user and gathered region 22 extending across the back of the neck of the user. When desired, the cape may be attached to the cover as described and connected together at the front. Drawstring 32 may be used to draw the cape about the base of the neck and under the chin as shown in FIGS. 1, 2, and 3.

Having thus described my invention and the matter of its use, it should be apparent that incidental changes may be made thereto that fairly fall within the scope of the following appended claims, wherein I claim:

1. An article of clothing comprising:

a visor having a bill extending outward above a face of a user, a cover fitted over said visor, said cover comprising:

an upper hair cover adopted for covering at least hair of a user above the nape of the neck, a bill portion attached to said upper hair cover and provided with an elastic periphery for engaging a lower side of said bill, whereby hair of a user covered by said upper hair cover is protected from precipitation.

2. An article of clothing as set forth in claim one further comprising a cape having an upper edge removably attachable to a lower edge of said upper hair cover rearward of said bill portion, said cape adapted to extend downward so as to cover sides of a head and shoulders of a user.

3. An article of clothing as set forth in claim 2 further comprising a drawstring extending across said cape for drawing said cape about a neck of a user.

4. An article of clothing as set forth in claim 3 further comprising fastening means positioned along front edges of said cape for fastening said front edges of said cape together.

5. An article clothing as set forth in claim 2 wherein said upper hair cover, said bill portion and said cape are constructed of a fabric material.

6. An article of clothing as set forth in claim 5 wherein said fabric material is of a water resistant character.

7. An article of clothing as set forth in claim 6 wherein said fabric material is permeable to gases and vapors.

8. An article clothing as set forth in claim one wherein a rearward region of said upper hair cover is of elastic character for holding said upper hair cover about a head of a user.

9. A cover for use in conjunction with a visor having a bill comprising:

an upper, generally circular hair cover constructed of a material having water resistant characteristics, for protecting hair of a user from precipitation, a bill cover attached to said hair cover, said bill cover provided with an elastic peripheral edge for engaging an edge of said bill, securing said cover in place over said bill and hair of a user, a cape of a material having water resistant characteristics and having an upper edge removably attached to an inside region of said upper hair cover which is adapted to extend around a back of a head of a user, said cape adapted to extend downward at least to the shoulders of a user, a drawstring slidably disposed in said cape so that said cape may be gathered about a neck of a user, whereby when a user leans forward said cape is held in place about a users neck and a hairdo of a user is undamaged by said cover.

10. A cover as set forth in claim 9 further comprising an elastic region about a rearward periphery of said circular hair cover, for holding said circular hair cover to a rear of a users head.

11. A cover as set forth in claim 10 wherein said material of said hair cover, said bill cover and said cape is permeable to vapor and air, permitting circulation of said vapor and air between an inside and outside of said cover.

12. A cover as set forth in claim 9 wherein said cape is adapted to extend downward over the shoulders of a user, and is further provided with closure means along front edges thereof, for closing said cape along said front edges.

13. A cover as set forth in claim 12 wherein said closure means comprises hook-and-loop tape secured to front edges of said cape.

14. A cover as set forth in claim 9 wherein an inside region of said upper hair cover and said upper edge of said cape is provided with hook-and-loop tape, for removably attaching said cape to said upper hair cover.

15. Head wear for protecting against precipitation and dampness comprising:

a visor having a bill adapted to extend outward above a face of a user, a removable visor cover comprising:

an upper, generally circular cover constructed of a water resistant material having vapor permeable characteristics, an elastic region in said upper cover adapted to extend around a back of a head of a user, a bill cover attached to said upper cover and provided with a front elastic region around a front periphery thereof, said front elastic region adopted for being positioned underneath a front edge of said bill, holding said bill cover and said upper cover in place on a head of a user, a cape having an upper edge removably attached to said elastic region of said upper cover, said cape constructed of a material having water resistant and vapor permeable characteristics, a drawstring slidably disposed in said cape so that said cape may be gathered about a neck of a user, closure means positioned along front edges of said cape for closing a front of said cape, whereby a user wearing said visor by itself may equip said visor with said visor cover and cape without disturbing a hair styling worn by a user, said cape protecting at least a rearward head and neck region and being secured about a neck of a user.

* * * * *